US007967926B2

(12) United States Patent
Tsuru et al.

(10) Patent No.: US 7,967,926 B2
(45) **Date of Patent: *Jun. 28, 2011**

(54) UOE STEEL PIPE EXCELLENT IN COLLAPSE STRENGTH AND METHOD OF PRODUCTION THEREOF

(75) Inventors: Eiji Tsuru, Futtsu (JP); Hitoshi Asahi, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/462,218

(22) Filed: Jul. 30, 2009

(65) Prior Publication Data

US 2009/0320965 A1 Dec. 31, 2009

Related U.S. Application Data

(62) Division of application No. 10/515,543, filed as application No. PCT/JP03/06486 on May 23, 2003.

(30) Foreign Application Priority Data

May 24, 2002 (JP) ..... 2002-150870
May 24, 2002 (JP) ..... 2002-151008
Jul. 1, 2002 (JP) ..... 2002-192531

(51) Int. Cl.
*C21D 9/08* (2006.01)

(52) U.S. Cl. ..... 148/521; 228/157

(58) Field of Classification Search ..... 148/12; 228/157

See application file for complete search history.

(56) References Cited

U.S. PATENT DOCUMENTS

| | | | | |
|---|---|---|---|---|
| 3,849,209 | A * | 11/1974 | Ishizaki et al. | 148/602 |
| 6,648,209 | B2 | 11/2003 | Hohl et al. | |
| 6,782,921 | B1 * | 8/2004 | Tsuru et al. | 138/142 |
| 2002/0066491 | A1 | 6/2002 | Lively | |
| 2003/0217795 | A1 | 11/2003 | Asahi et al. | |
| 2005/0178456 | A1 * | 8/2005 | Tsuru et al. | 138/171 |

FOREIGN PATENT DOCUMENTS

| | | |
|---|---|---|
| JP | 9-1233 | 1/1997 |
| JP | 9-3545 A | 1/1997 |
| JP | 9-49025 | 2/1997 |
| JP | 10-176239 A | 6/1998 |
| JP | 2002-102931 A | 4/2002 |

OTHER PUBLICATIONS

UOE, Nov. 20, 1980, pp. 1112-1121, 1129-1131.

* cited by examiner

*Primary Examiner* — Roy King
*Assistant Examiner* — Jie Yang
(74) *Attorney, Agent, or Firm* — Kenyon & Kenyon LLP

(57) ABSTRACT

The present invention relates to UOE steel pipe excellent in collapse characteristics formed by the UOE production method and a method for forming this UOE steel pipe, said UOE steel pipe characterized in that a ratio between compression and tension of yield strength in the circumferential direction is at least 1.05 near the inside surface and is at least 0.9 to not more to 1.0 from the center of plate thickness to the outside surface.

3 Claims, 9 Drawing Sheets

UOE STEEL PIPE EXCELLENT IN COLLAPSE STRENGTH AND METHOD OF PRODUCTION THEREOF

This application is a division of U.S. Ser. No. 10/515,543, filed Nov. 23, 2004, which is a national stage application of International Application No. PCT/JP03/06486, filed May 23, 2003, which claims priority to Japanese Application Nos. 2002-150870, filed May 24, 2002; 2002-151008, filed May 24, 2002; and 2002-192531, filed Jul. 1, 2002, each of which is incorporated by reference in its entirety.

TECHNICAL FIELD

The present invention relates to UOE steel pipe excellent in collapse characteristics formed by the UOE production method and a method for forming this UOE steel pipe.

BACKGROUND ART

In recent years, as a method of long-distance transport of crude oil and natural gas, the importance of line pipe has been rising. In particular, submarine line pipes traversing the seas have reached depths of as much as 3000 meters. In general, in the design of pipelines, first the inside diameter of the steel pipe is determined by the amount of fluid transport, then the thickness and grade are determined while considering the crack propagation characteristics for keeping the stress in the circumferential direction at the time of application of internal pressure at a predetermined value and the corrosion loss. However, along with the greater depths reached, the water pressure rises. The collapse strength, which had not been considered that important in the past, is now becoming an issue. The collapse strength is correlated with the ratio of the outside diameter and thickness. By raising the collapse strength of steel pipe, it becomes possible to make the diameter greater and the thickness smaller. Therefore, the collapse strength has begun to become a main design factor determining the size of steel pipe.

However, the collapse strength of steel pipe has been studied for a long time now in oilfield pipes. Statistically a large number of experimental formula have been proposed. Among these, the outside diameter/thickness ratio, yield strength, circularity, thickness evenness, and residual stress have been considered the main-governing factors. These studies have mainly been performed for seamless steel pipe of uniform grade, so it was not necessary to discuss the anisotropy of materials much.

However, in trunkline pipe used for long-distance transport, since the diameter is large, steel pipe made by the method of production of the UOE process has been used. The process of production of steel pipe of the UOE process, as shown in FIG. 1, is comprised of a process of C-ing (pressing), U-ing (pressing), O-ing (pressing), seam welding, and expansion. Further, in the O-ing, as shown in FIG. 2, the diameter is reduced by an O-mold. This is called "upset" of O-ing. Further, expansion is a process of correcting the circularity by pushing outward from the inside by metal segments. Tensile stress in the circumferential direction is applied for plastic deformation. These bending, compression, and tension forming are all performed cold, so the final product, that is, the steel pipe, is given anisotropy in the mechanical properties by the combination of the work hardening and the Bauschinger effect. Note that the Bauschinger effect is the phenomenon of the yield strength dropping in the opposite direction to plastic strain given to a material. Therefore, UOE steel pipe given plastic strain of the tensile direction in the circumferential direction falls in compression yield strength in the circumferential direction, that is, the yield strength with respect to application of outside pressure, due to the Bauschinger effect.

On the other hand, since the direction of application of the main strain at the time of forming perpendicularly intersects the application of load in the axial direction, there is little difference in the stress behavior between application of tension and compression in the axial direction. Further, when the application of load in the circumferential direction is tensile stress, that is, if designing the strength based on the value obtained from a total thickness tensile test for the application of inside pressure, this issue does not arise.

However, in recent years, demand for UOE steel pipe able to be applied to deep sea line pipe has been rising. The collapse strength of steel pipe due to outside pressure has begun to become an issue. Collapse is a phenomenon where the steel pipe is crushed by outside pressure and is a type of buckling; so the yield strength of compression determines the collapse strength. Therefore, when applying UOE steel pipe to line pipe where collapse strength is required, the drop in the compression strength in the circumferential direction due to the Bauschinger effect becomes an issue.

To deal with such issues, the method of using a gas burner to heat steel pipe to at least 150° C. after expansion has been disclosed in Japanese Unexamined Patent Publication (Kokai) No. 9-3545. However, even if performing such heating, it does not mean that the collapse strength of all UOE steel pipe will be improved by 20% or more. Steel pipe with small recovery from the Bauschinger effect due to heating is also seen. Further, for the method of restoring the drop in the compression yield strength by heat treatment, Japanese Unexamined Patent Publication (Kokai) No. 9-49025 discloses and reports numerous research papers. In these methods, the compression yield strength dropping due to forming is restored to the level of the plate material before forming and the collapse strength of UOE steel pipe is improved to a certain extent.

However, if using welding heat or a heat treatment furnace to heat the steel pipe as a whole, in the process of production by the UOE process, work hardening due to compressive strain occurring from the inside surface of the steel pipe to the center of thickness (hereinafter referred to as the "inside surface side") is also lost. Therefore, the method of improvement of the collapse strength by uniformly heat treating UOE steel pipe as a whole cannot be said to be extremely effective.

DISCLOSURE OF INVENTION

The present invention has as its object to provide. UOE steel pipe improved in collapse strength by heat treatment to leave work hardening obtained by cold working the inside surface side and to eliminate the Bauschinger effect from the outside surface to the center of thickness (hereinafter referred to as the "outside surface side").

Further, the present invention has as its object to provide UOE steel pipe improved in collapse strength by optimizing the UOE production process even without heat treatment.

To achieve these objects, the inventors first engaged in detailed studies to clarify the changes in the collapse strength in the thickness direction of UOE steel pipe. As a result, they discovered that the compression yield strength at the outside surface side falls compared with steel plate before forming and rises at the inside surface side. From this discovery, they studied in detail a heat treatment method for improving the compression yield strength of the outside surface side to equal to that of steel plate and maintaining the compression yield strength at the inside surface side and suppressing the drop in strength in the axial direction by heat treatment making the outside surface a high temperature and the inside surface a low temperature. As a result, they discovered the optimal heat treatment conditions and succeeded in producing UOE steel pipe excellent in collapse strength.

Further, the inventors took note of the improvement in the collapse strength by giving compressive plastic strain from the inside surface of UOE steel pipe to the center of thickness (hereinafter referred to as the "inside surface side") and optimized the ratio of the upset rate at the time of O-ing and the expansion rate at the time of expansion to give compressive plastic strain to the inside surface side and keep the drop in the compression yield stress to a minimum.

Further, the inventors studied in detail the effect of the collapse strength dropping due to the Bauschinger effect being restored due to heating by going back over the chemical composition of the steel plate material of the steel pipe and the rolling, accelerated cooling, and other production conditions. As a result, they learned that the compression strength of Nb-containing steel cooled after hot rolling to the low temperature region of 300° C. or less is higher than steel plate air-cooled after hot rolling or steel plate water-cooled to 500 to 600° C. and then stopped being cooled. Further, if producing steel pipe by the UOE process and heating to the range of 80 to 550° C. after expansion, they learned that the collapse strength is restored to at least the same level as before expansion. Further, they learned that this effect becomes more conspicuous by addition of Ti and that even if heating to a low temperature of 80 to less than 150° C., the Bauschinger effect is recovered from.

The present invention was made based on this discovery and has as its gist the following:

(1) UOE steel pipe excellent in collapse strength produced by successively C-ing, U-ing, and O-ing steel plate, seam welding the ends of the steel pipe, and expanding the pipe, said UOE steel pipe characterized in that a ratio between compression and tension of yield strength in the circumferential direction is at least 1.05 near the inside surface and is at least 0.9 to not more to 1.0 from the center of plate thickness to the outside surface.

(2) UOE steel pipe excellent in collapse strength produced by successively C-ing, U-ing, and O-ing steel plate, seam welding the ends of the steel pipe, and expanding the pipe, said UOE steel pipe characterized in that by applying heat treatment after producing the UOE steel pipe so that a heating temperature $T_1$ of the outside surface of said steel pipe and a heating time $t_1$ of the outside surface satisfy the following formula (1) and a heating temperature $T_2$ of an inside surface of said steel pipe and a heating time $t_2$ of the inside surface satisfy the following formula (2), a ratio between compression and tension of the yield strength in the circumferential direction is at least 1.05 near the inside surface and at least 0.9 to not more than 1.0 from the center of thickness to the outside surface:

$$T_1-503 \geqq -37.6\times\ln t_1 \quad (1)$$

$$T_2-407 < -31.3\times\ln t_2 \quad (2)$$

where, $T_1$: heating temperature of outside surface of steel pipe (° C.), $t_1$: heating time of outside surface of steel pipe (s)

$T_2$: heating temperature of inside surface of steel pipe (° C.), $t_2$: heating time of inside surface of steel pipe (s)

(3) A method of production of UOE steel pipe excellent in collapse strength produced by successively C-ing, U-ing, and O-ing steel plate, seam welding the ends of the steel pipe, and expanding the pipe, said method of production of UOE steel pipe characterized in that a ratio between an upset rate $\alpha$ at the time of said O-ing and an expansion rate $\beta$ at the time of expansion is $\alpha/\beta \geqq 0.35$ and a ratio of compression and tension of yield strength in the circumferential direction is at least 1.05 near the inside surface and is at least 0.9 to not more to 1.0 from the center of plate thickness to the outside surface.

(4) UOE steel pipe excellent in collapse strength characterized by containing, by wt %, C: 0.03 to 0.15%, Si: 0.8% or less, Mn: 0.3 to 2.5%, P: 0.03% or less, S: 0.01% or less, Nb: 0.01 to 0.3%, Ti: 0.005 to 0.03%, Al: 0.1% or less, and N: 0.001 to 0.01% and a balance of Fe and unavoidable impurities and in that a ratio of compression and tension of yield strength in the circumferential direction is at least 1.05 near the inside surface and is at least 0.9 to not more to 1.0 from the center of plate thickness to the outside surface.

(5) UOE steel pipe excellent in collapse strength as set forth in (4), characterized by further containing, by wt %, one or two or more of Ni: 1% or less, Mo: 0.6% or less, Cr: 1% or less, Cu: 1% or less, V: 0.3% or less, B: 0.0003 to 0.003%, Ca: 0.01% or less, REM: 0.02% or less, and Mg: 0.006% or less.

(6) A method of production of UOE steel pipe excellent in collapse strength produced by successively C-ing, U-ing, and O-ing steel plate, seam welding the ends of the steel pipe, and expanding the pipe, said method of production of UOE steel pipe characterized by applying heat treatment after producing the UOE steel pipe so that a heating temperature $T_1$ of the outside surface of said steel pipe and a heating time $t_1$ of the outside surface satisfy the following formula (1) and a heating temperature $T_2$ of an inside surface of said steel pipe and a heating time $t_2$ of the inside surface satisfy the following formula (2):

$$T_1-503 \geqq -37.6\times\ln t_1 \quad (1)$$

$$T_2-407 < -31.3\times\ln t_2 \quad (2)$$

where, $T_1$: heating temperature of outside surface of steel pipe (° C.), $t_1$: heating time of outside surface of steel pipe (s)

$T_2$: heating temperature of inside surface of steel pipe (° C.), $t_2$: heating time of inside surface of steel pipe (s)

(7) A method of production of UOE steel pipe excellent in collapse strength as set forth in (6), said method of production of UOE steel pipe characterized in that said heat treatment is performed by induction heating.

(8) A method of production of UOE steel pipe excellent in collapse strength as set forth in (7), said method of production of UOE steel pipe characterized by coating the pipe during said heat treatment or during the cooling after the heat treatment.

(9) A method of production of UOE steel pipe excellent in collapse strength produced by successively C-ing, U-ing, and O-ing steel plate, seam welding the ends of the steel pipe, and expanding the pipe, said method of production of UOE steel pipe characterized by making a ratio between an upset rate $\alpha$ at the time of said O-ing and an expansion rate $\beta$ at the time of expansion $\alpha/\beta \geqq 0.35$.

(10) A method of production of UOE steel pipe excellent in collapse strength characterized by heating a steel slab comprising, by wt %, C: 0.03 to 0.15%, Si: 0.8% or less, Mn: 0.3 to 2.5%, P: 0.03% or less, S: 0.01% or less, Nb: 0.01 to 0.3%, Ti: 0.005 to 0.03%, Al: 0.1% or less, and N: 0.001 to 0.01% and a balance of Fe and unavoidable impurities to a temperature of the austenite region, then rough rolling it at a temperature of the recrystallization region, finishing rolling it at the nonrecrystallization temperature region of not more than 900° C. by a cumulative reduction rate of 50% or more, cooling it from a temperature of the $Ar_3$ point or more by a cooling rate of 5 to 40° C./s until 300° C. or less to produce thick steel plate, successively C-ing, U-ing, and O-ing this, seam welding the ends of the steel pipe, and expanding the pipe in a UOE process to produce steel pipe and heating the range from at least the outside surface to the center of thickness to a range of 80 to 550° C.

(11) A method of production of UOE steel pipe as set forth in (10), said method of production of UOE steel pipe excellent in collapse strength characterized by further containing, by wt %, one or two or more of Ni: 1% or less, Mo: 0.6% or less, Cr: 1% or less, Cu: 1% or less, V: 0.3% or less, B: 0.0003 to 0.003%, Ca: 0.01% or less, REM: 0.02% or less, and Mg: 0.006% or less.

(12) UOE steel pipe excellent in collapse strength as set forth in (4) or (5), said UOE steel pipe characterized in that a ratio between a compressive strength a (MPa) of steel pipe produced by said UOE process and a collapse-strength b (MPa) of steel pipe produced by the UOE process after heating a range from an outside surface of said steel pipe to a center of thickness to 80 to 550° C. is at least 1.10.

(13) UOE steel pipe excellent in collapse strength as set forth in (4) or (5), said UOE steel pipe characterized by being coated during said heat treatment or cooling after heat treatment.

BEST MODE FOR CARRYING OUT THE INVENTION

Figure 4:
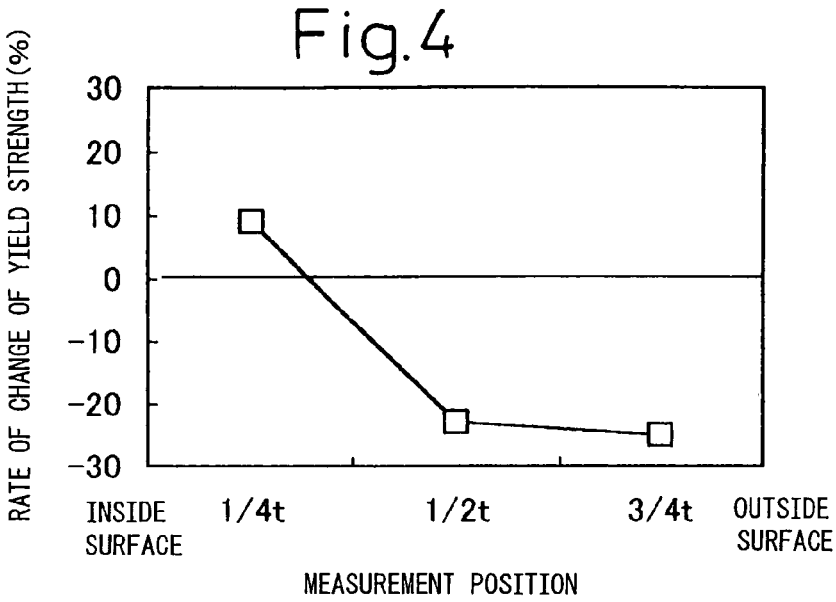
FIG. 4 is a view of changes in the rate of change of the compression yield strength according to the position in the thickness section.

The inventors first examined a typical size of UOE steel pipe used for deep sea line pipe, that is, diameter 660×25.4 mm, X-65, for compressive stress-strain behavior in the circumferential direction over the entire cross-section. For test pieces, they obtained columnar shapes of diameters of 6 mm and lengths of 15 mm at ¼ the total thickness from the outside surface, ¼ the total thickness from the inside surface, and the center of thickness using the circumferential direction as longitudinal. FIG. 4 plots the rate of change of the compression yield strength with respect to the positions of obtaining the test pieces in the thickness direction. The rate of change of the compression yield strength is the percentage obtaining by subtracting the compression strength of the steel plate before forming from the compression yield strength of the steel pipe and dividing the result by the compression strength of the steel plate before forming. From this, they learned that at the outside surface side, the compression yield strength falls by at least about 20% with respect to the steel plate before forming, but conversely rises at the inner surface side.

Up until now, in the UOE process, it had been considered that in the end, the Bauschinger effect arising due to tensile strain at the time of expansion caused a drop in the compression yield strength at the plate thickness as a whole. However, in fact, the inventors discovered that the drop in the compression yield strength is limited to the outside surface side and that, at the inside surface side, work hardening of compression due to bending during pipe production remains even after expansion and the compression yield strength rises.

From the above, they turned to and studied a heat treatment method for restoring the compression yield strength at the outside surface side which fell at the time of forming and maintaining the compression yield strength at the inside surface side which had risen at the time of forming.

Figure 5:
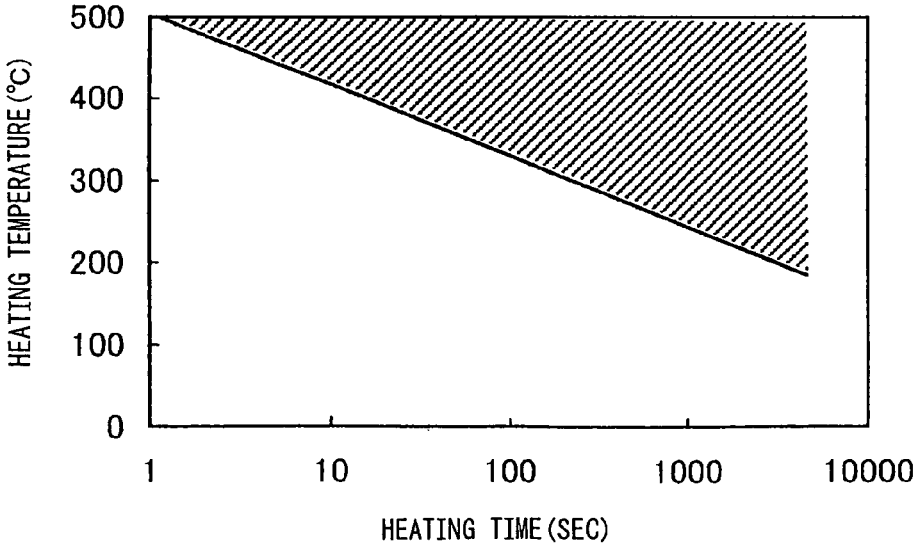
FIG. 5 is a view of the relationship between the heating temperature and time at the outside surface of steel pipe for obtaining a high collapse strength.

It is well known that the mechanical properties of steel which change due to cold strain are restored by heat treatment. Therefore, they gave tensile prestraining and then applied heat treatment to X-65 and X-80 with established records as line pipe and further materials having high strengths of 800 MPa or more and investigated the heating temperature and heating time until the compression yield strength which fell due to tensile prestraining recovered to 90%. As a result, they learned that the optimal heat treatment conditions largely depend on the grade or a 1% or higher prestraining and is in the relationship of FIG. 5. If converting this to a formula, this is represented by formula (1) with respect to a temperature of 180° C. or more:

$$T_1-503 \geqq -37.6\times\ln t_1 \quad (1)$$

where, $T_1$: heating temperature of outside surface of steel pipe (° C.)

$t_1$: heating time of outside surface of steel pipe (s)

Note that the heating temperature $T_1$ of the outside surface is preferably set to an upper limit of not more 700° C. so as not to allow phase transformation or other structural changes. The upper limit of time is preferably set to not more than 6000 seconds if considering the productivity.

Figure 6:
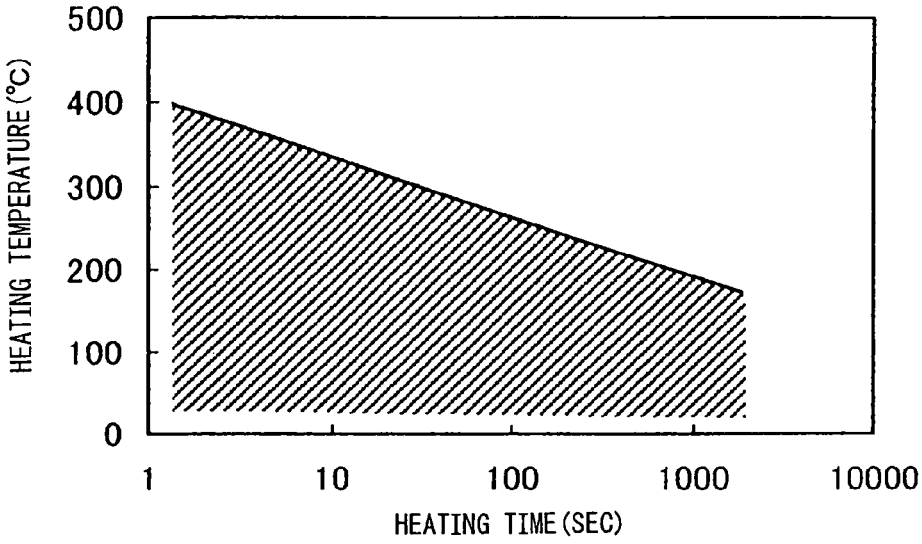
FIG. 6 is a view of the relationship between the heating temperature and time at the inside surface of steel pipe for obtaining a high collapse strength.

Further, the inventors similarly studied the compressive prestraining and examined the heat treatment conditions enabling the yield strength increased due to work hardening to be maintained, whereby they found that this does not greatly depend on the grade or the 1% or higher prestraining. The relationship of FIG. 6 was obtained and establishment of a formula was possible by formula (2):

$$T_2-407 < -31.3\times\ln t_2 \quad (2)$$

where, $T_2$: heating temperature of inside surface of steel pipe (° C.)

$t_2$: heating time of inside surface of steel pipe (s)

Note that the heating temperature $T_2$ of the inside surface is preferably as low as possible, but in practice, due to heat conduction from the outside surface, the lower limit becomes about 100° C. Further, the lower limit of the heating time $t_2$ of the inside surface is not defined. It is also possible to immediately cool after reaching the heating temperature $T_2$. The upper limit depends on the heat conduction from the outside surface, so is not defined.

Figure 7:
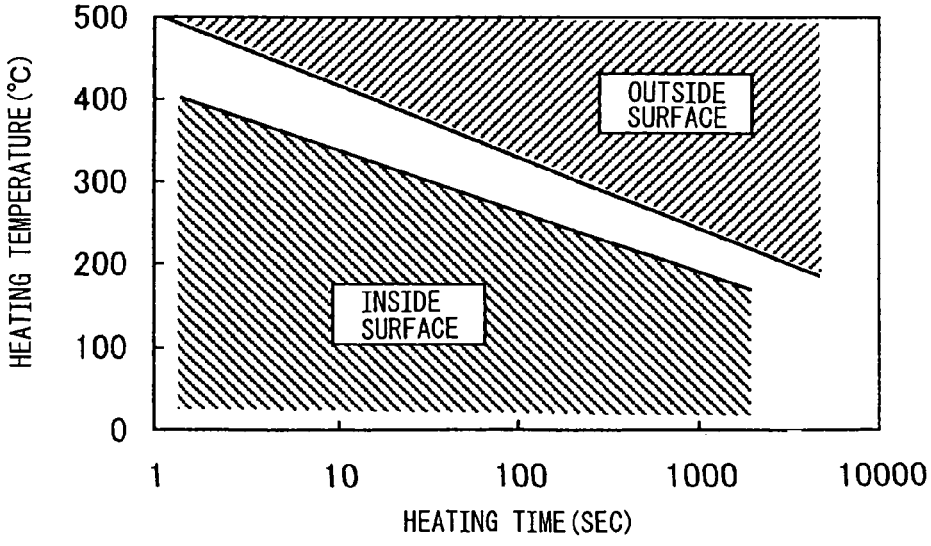
FIG. 7 is a view of the combination of the outside surface and inside surface temperatures for obtaining a high collapse strength.

That is, as shown in FIG. 7, by heating to an outside surface temperature and inside surface temperature to separate temperature-time ranges, the inventors succeeded in maintaining the compression yield strength at the inner surface side rising due to work hardening and raising the compression yield strength at the outside surface side falling due to the Bauschinger effect. At this time, as shown by the data of Invention 1 of FIG. 8, they maintained compression yield strength at the inner surface at 1.1 times or more the tension yield strength and restored the compression yield strength at the outer surface to at least 90% the tension yield strength. The method of measurement of FIG. 8 etc. will be explained in Example 1.

The rate of drop in the compression yield strength at the outer surface side due to the Bauschinger effect does not depend on the magnitude of the tension strain due to the bending at the time of pipe production changing due to the magnitude of the tensile strain at the time of expansion and the thickness. On the other hand, the rise in the compression yield strength at the inner surface side depends on the degree of the work hardening changing depending on the magnitude of the compression strain at the time of O-ing and the thickness. Therefore, the greater the thickness, the more the compression yield strength of the outer surface side does not change and the larger the compression yield strength at the inner surface side, so in deep sea line pipe steel pipe with a thickness of 25 to 40 mm or so, the effect of the present invention becomes extremely conspicuous. Further, it is known that the mode of collapse can be differentiated by the outside diameter/thickness ratio. With a thin material, elastic collapse where the collapse strength is not dependent on the compression yield strength is exhibited. The thinner, the more the trend toward transition collapse, plastic collapse, and yield collapse dependent on the compression yield strength. The general size of line pipe is relatively thin, so is in the elastic collapse region, but the size applied to deep seas is thick, so the compression yield strength starts to be strongly affected. Therefore, maintenance of the compression yield strength of the inner surface side and recovery of the compression strength at the outer surface side due to the heat treatment of the present invention are effectively exhibited.

Further, to obtain a temperature hysteresis with a temperature gradient where the outside surface is high temperature and the inside surface is low temperature, the method of heating the outside surface by induction heating is extremely effective. It is possible to easily give a sharp temperature distribution to the inner and outer surfaces in a short time. The temperature distribution may be obtained by suitably optimizing the depth of penetration of the induction heating and the steel pipe conveyance speed in relation to the thickness. In addition to induction heating, the method for obtaining the temperature distribution of the present invention may be realized by heating in an oil tank or salt bath or other atmosphere with a large coefficient of heat conduction from the outside surface or by forced cooling from the inside surface.

Further, it is possible to use the latent heat after heat treatment to coat extremely efficiently. With submarine line pipe, the corrosion resistance is mainly improved by coating the outside surface of the steel pipe with plastic. This plastic or other coating has to be applied at a temperature of about 150 to 250° C. to raise the bonding strength.

Therefore, when heating the steel pipe as a whole to a high temperature to improve the collapse strength as in the past, in particular when the thickness is large, a longer wait time is necessary until the suitable temperature range is reached. In the present invention, the temperature difference between the inside surface and outside surface is large, so the drop in the outside surface temperature due to heat conduction in the thickness direction is fast and the suitable temperature for coating is reached in a short time. Due to this, the number of coatings per time increases, the collapse strength is improved, and production cost can be slashed.

Figure 8:
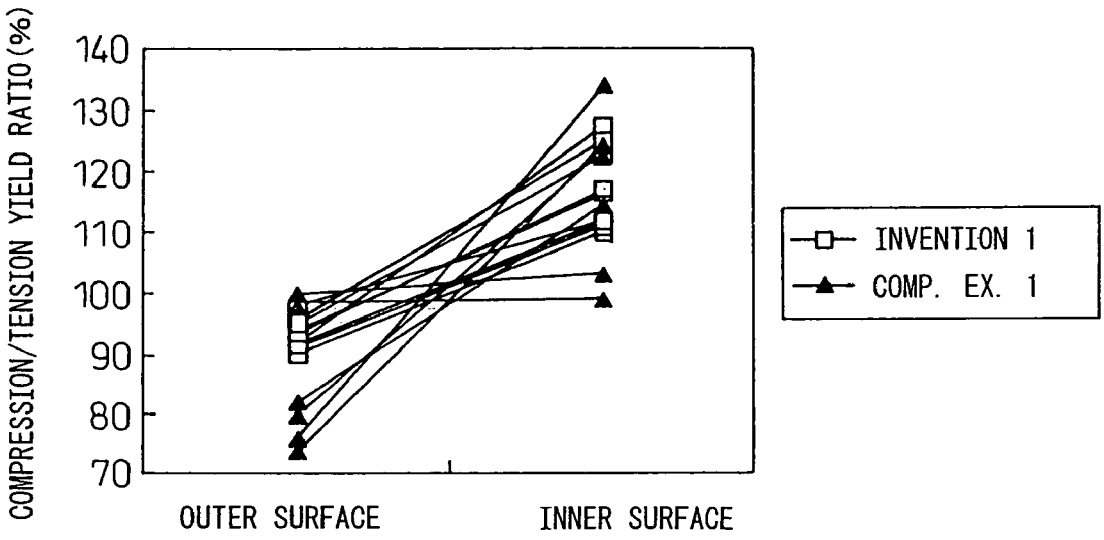
FIG. 8 is a view of the difference in the compression/tension yield ratio at the outer surface and inner surface of steel pipe.

When applying a coating agent during the heat treatment, sometimes the inside surface temperature may exceed the temperature-time conditions of the inside surface defined by the present invention. However, the temperature range of the inside surface of the present invention is possible in terms of heat conduction when holding the outside surface in the temperature range of the present invention and is defined to the range where the work hardening of the inside surface side is not lost. Therefore, even if the scope of the present invention is not satisfied due to the relationship between the temperature-time of the outside surface and inside surface at the time of coating not being possible in terms of heat conduction, the relationship between the temperature-time at the time of heat treatment is included in the present invention if formula (1) and formula (2) are satisfied. At this time as well, as shown in FIG. 8, the compression yield strength at the inner surface is maintained at 1.05 times or more the tension yield strength and the compression yield strength of the outer surface recovers to at least 90% of the tension yield strength.

Figure 9:
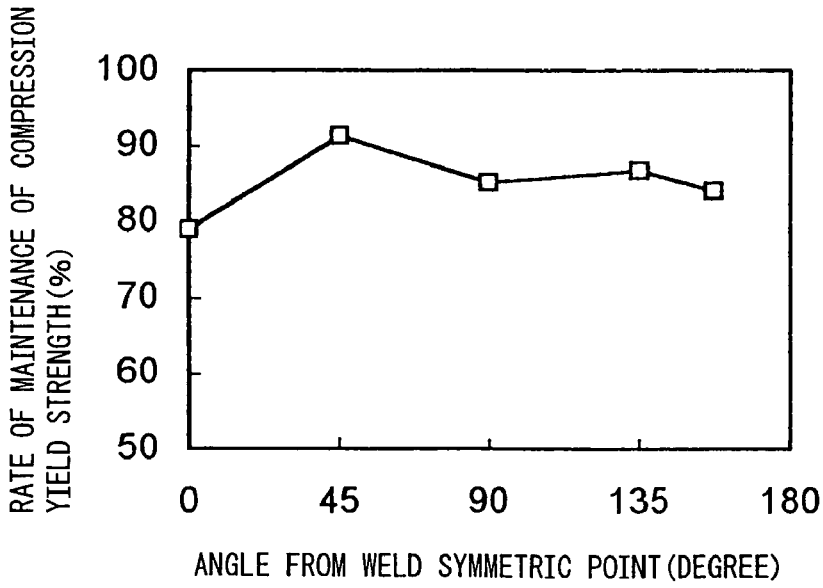
FIG. 9 is a view of the distribution of the rate of maintenance of the compression yield strength of UOE steel pipe.

Next, the inventors examined in detail the compression yield strength in the circumferential direction from the outside surface of the steel plate to the center of thickness (hereinafter referred to as the "outside surface side") at the cross-section of steel pipe produced by the UOE process while changing the position of taking the test pieces in the circumferential direction. The test pieces were made columnar shapes of diameters of 6 mm and lengths of 15 mm with the circumferential directions as longitudinal. The results are shown in FIG. 9, where the abscissa indicates the counterclockwise angle from the axially symmetric part of the seam weld of the steel pipe as 0°. The seam weld was 180°. The rate of maintenance of the compression yield strength of the ordinate is the percent of the compression yield strength of the steel pipe divided by the compression strength of the steel plate before forming. The inventors learned that the compression yield strength at the outside surface side of the steel pipe falls to 80 to 90% of the compression yield strength of the steel plate. Therefore, they analyzed the strain behavior at the different processes of C-ing, U-ing, O-ing, and expansion shown in FIG. 1. As a result, they learned that the largest tensile plastic strain occurs in U-ing, compressive plastic strain occurs due to the compression stress slightly exceeding the compression yield strength at the time of upset in O-ing, and tensile plastic strain occurs due to the tensile stress exceeding the tension yield strength again at the time of expansion.

Therefore, the inventors took note of the possibility of being able to suppress the drop in the compression yield stress at the outside surface side by controlling the balance between the compressive plastic strain at the time of upset in O-ing and the tensile plastic strain at the time of expansion. The Bauschinger effect is the phenomenon of the yield strength dropping in the opposite direction to the plastic strain, so the inventors tried to suppress the drop in the compression yield stress at the outside surface side by increasing the upset rate to apply more compressive plastic strain and reducing the expansion rate to reduce the tensile prestraining.

Figure 10:
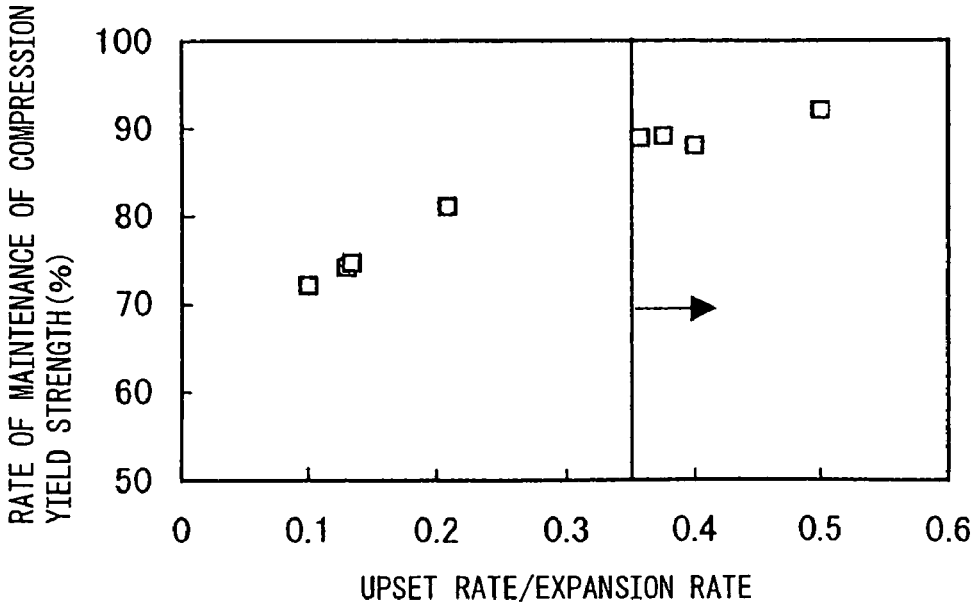
FIG. 10 is a view of the change of the rate of maintenance of the compression yield strength by the ratio of the upset rate/expansion rate.

The test was conducted by producing steel pipe with an outside diameter/thickness of 18.7 while changing the ratio of the upset rate $\alpha$ and the expansion rate $\beta$ at the time of O-ing and obtaining compression test pieces centered at ¼ of the total thickness from the outside surface of the axially symmetric part from the weld. The results are shown in FIG. 10 as the change of the rate of maintenance of the compression yield strength with respect to $\alpha/\beta$. Here, the upset rate and the expansion rate are based on the following definitions.

Figure 11:
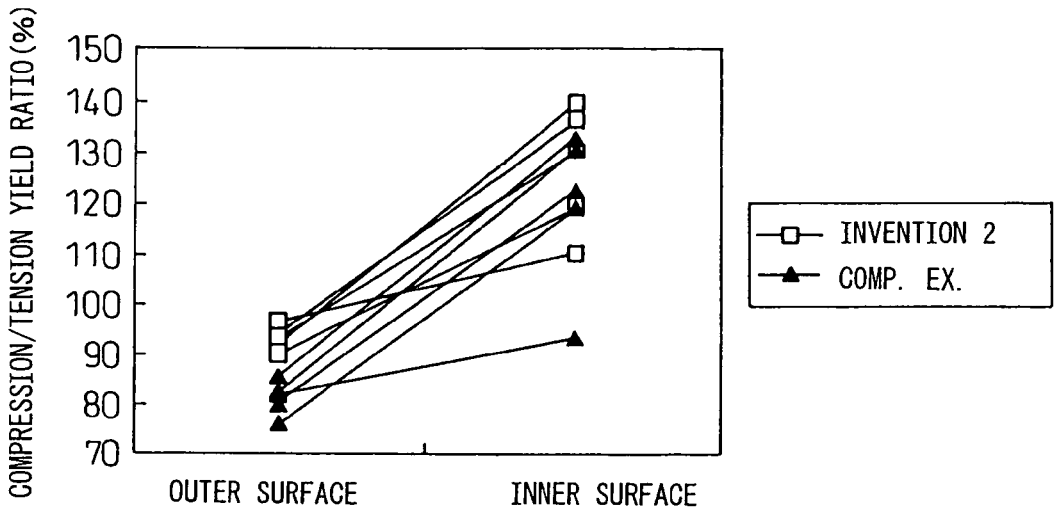
FIG. 11 is a view of the difference of the compression/tension yield ratio at the outer surface and inner surface of steel pipe.
Figure 13:
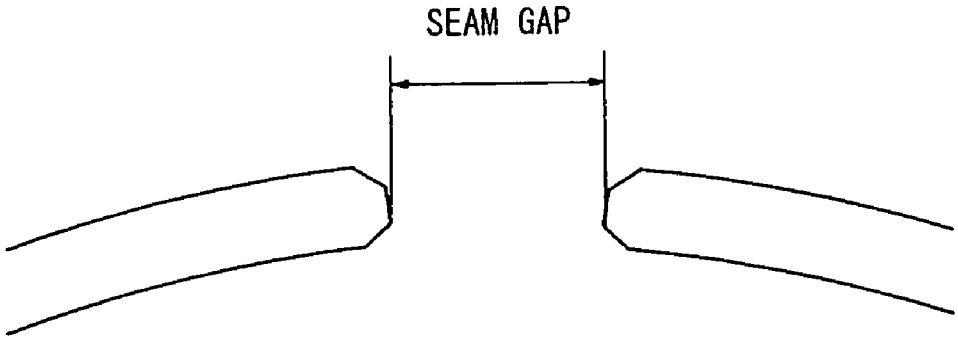
FIG. 13 is a schematic view of a seam gap at a weld.
Figure 14:
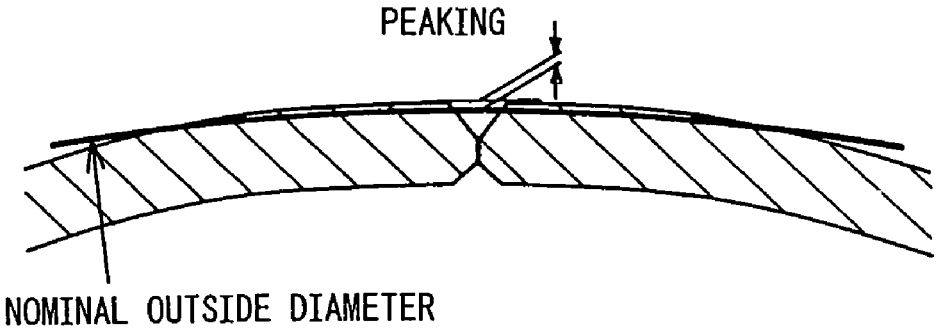
FIG. 14 is a schematic view of peaking at a weld.
Figure 15:
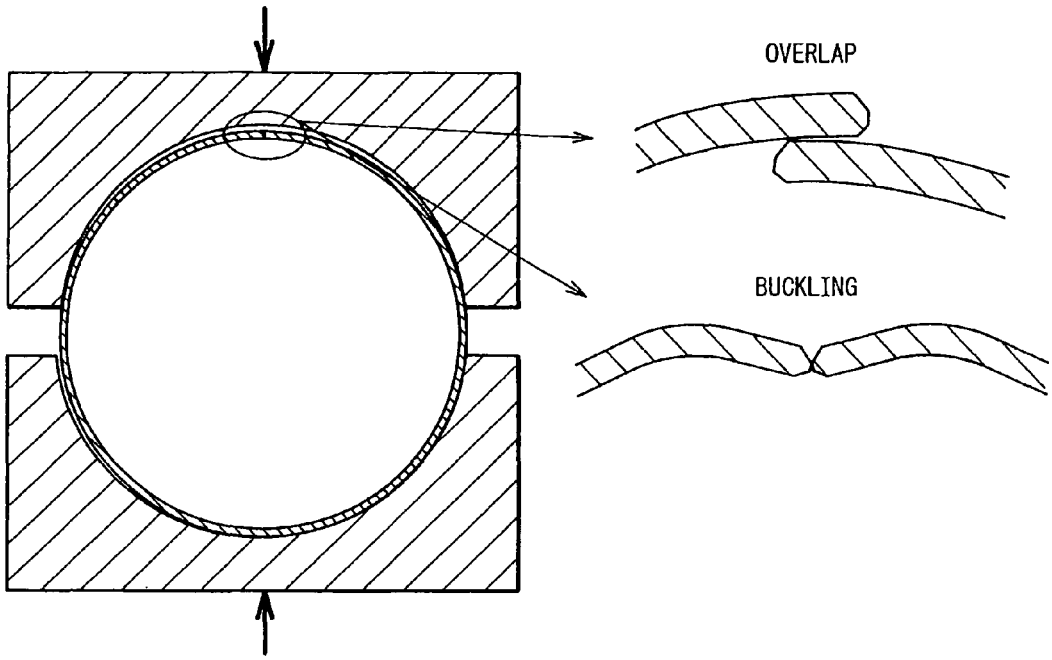
FIG. 15 is a schematic view of overlap and buckling at beveling.
Figure 16:
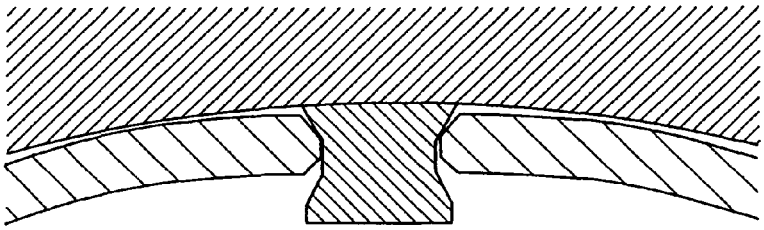
FIG. 16 is an example of an O-ing mold projecting shape.

The inventors clarified that by setting $\alpha/\beta \geqq 0.35$, the rate of maintenance of the compression yield strength reaches 90% and thereby set the lower limit of $\alpha/\beta$ to 0.35. The upper limit of $\alpha/\beta$ depends on the preferable range and optimal range of the upper limit of $\alpha$ and the lower limit of $\beta$ explained later. The preferable range is not more than 1, while the optimal range is not more than 0.6. The lower limit of a is preferably at least 0.3% from the minimization of the seam gap before welding and reduction of peaking of the welds as shown in FIG. 13 and FIG. 14. For the upper limit of $\alpha$, the higher, the more easily the reduction in the compression yield strength can be inhibited, but at the time of O-ing, overlap or buckling of the beveling such as shown in FIG. 15 easily occurs, so while depending on the relationship of the outside diameter/thickness, the upper limit is preferably made 0.5% or less. Note that to prevent overlap and buckling of beveling, providing projections having tapers expanding toward the axial center at positions corresponding to the seam welds at the inner surface of an O-ing mold such as shown in FIG. 16 is effective. FIG. 11 shows the difference in the compression/tension yield ratio at the outer surface and inner surface of the steel pipe. In this way, as shown by the data of Invention 2 of FIG. 11, with steel produced with an $\alpha/\beta$ of 0.35 or more to 0.6 or less, the compression yield strength of the inner surface was maintained at 1.1 times the tension yield strength or more, while the compression yield strength of the outer surface became at least 90% the tension yield strength. Note that the method of measurement of FIG. 11 will be explained in Example 2.

The inventors examined in detail the relationship between the heating temperature and chemical composition and structure of steel relating to the phenomenon of the yield strength falling due to the Bauschinger effect being restored due to heat treatment. First, they produced steel containing various ingredients while changing the hot rolling conditions in the laboratory and worked the tension test pieces from these steels to impart 4% tensile strain. Next, they heated the test pieces at 50 to 700° C. for 10 minutes, obtained compression test pieces from the tension test pieces as tensed and after heating, and conducted compression tests. They used the ratio of 0.2% yield strength of these test pieces in the compression test and the 2% yield strength in the compression test of material before imparting tension (hereinafter referred to as the "compression strength ratio.") as the judgment criteria.

As a result, the inventors learned that the compression strength ratio of the Nb-containing steel cooled after hot rolling to the low temperature region of 300° C. or less becomes higher than steel air-cooled after hot rolling and steel water-cooled after hot rolling to 500 to 600° C. and the stopped being cooled and that the compression strength ratio exceeds 1.0 due to heat treatment at 80 to 550° C. Further, it became clear that if heating Nb—Ti-containing steel to 80 to less than 150° C., this effect is obtained.

As opposed to this, with steel not containing Nb—Ti stopped being cooled at 500 to 600° C., even if heating to 80 to less than 150° C., the compression strength ratio did not change at all. Further, they learned that even if heating to a temperature of 150° C. or more, the effect of recovery from the Bauschinger effect is smaller for steel not containing Nb—Ti stopped being cooled at 500 to 600° C. compared with steel containing Nb—Ti stopped being cooled at 300° C. or less.

The inventors examined the microstructure of steel coiled at this 300° C. or less and as a result found that this steel has a structure including upper bainite and other low temperature transformation phases. Such low temperature transformation phases are considered to suppress the drop in the compression yield strength due to the Bauschinger effect. Further, the reasons why the compression yield stress after expansion rises to equal or better than the compression yield strength before expansion are believed to be because the site of stress around dislocation causing the Bauschinger effect easily changes and C and other elements present in solute state fix firmly to dislocation.

Further, the inventors analyzed the precipitate in detail and as a result learned that fine TiN precipitates in Ti-containing steel. It is considered that due to the fine TiN, the coarsening of the austenite grains at the time of slab reheating and at the HAZ is suppressed and that the microstructure of the base material and HAZ becomes finer. As a result of such a uniform, fine microstructure being obtained, they discovered that the nonuniformity of the stress in the grains is mitigated, the residual stress easily becomes uniform, and the collapse strength falling due to the Bauschinger effect is easily improved by low temperature heat treatment due to the synergistic effect with the addition of Nb.

The inventors made the steel plate produced in this way into steel pipe by the UOE process and examined in detail the drop in the compression yield strength due to the Bauschinger effect in the thickness direction from the outside surface side of the steel pipe to the inside surface side. As a result, they learned that the outside surface side receives the tensile strain in the circumferential direction in the process for forming into a cylindrical shape and the process of expansion, that due to the Bauschinger effect, the compression yield strength falls, that at the inner surface side, work hardening of compression due to bending in the UO process remains even after expansion, and the compression yield strength does not fall.

Further, the inventors studied the effect of heating on the drop in the compression yield strength due to the Bauschinger effect at the surface layer, center of thickness, and ¼ thickness of the thickness direction from the outside surface side to the inside surface side of the steel pipe. As a result, they learned that the effect of heating the inside surface side is small, but that heating the outside surface side improves the collapse strength. This heating is effective in the range of 80 to 550° C. Further, even in the range of 80 to 250° C., the effect is large. An effect was also recognized at a low temperature of 80 to less than 150° C.

Figure 12:
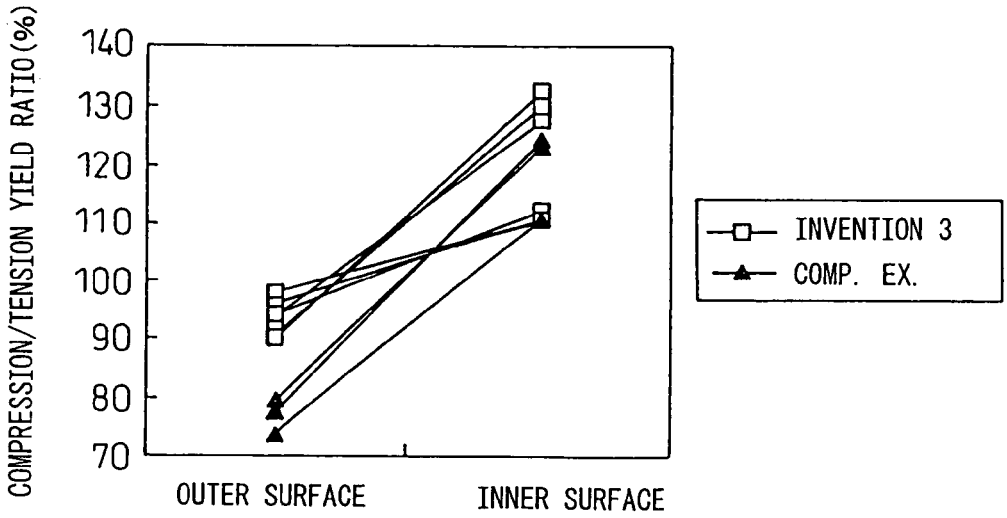
FIG. 12 is a view of the difference of the compression/tension yield ratio at the outer surface and inner surface of steel pipe.

Here, for this steel pipe, as shown by the data of Invention 3 of FIG. 12, by heating at 80 to 550° C., the compression yield strength at the inner surface is maintained at 1.05 times or more the tension yield strength and the compression yield strength at the outer surface becomes at least 90% the tension yield strength. In particular, for this steel pipe, by heating at 120 to 250° C., the compression yield strength at the inner surface is maintained at least at 1.1 times the tension yield strength. The method of measurement of FIG. 12 will be explained in Example 3.

Next, the reasons for limitation of the component elements will be explained.

The amount of C is limited to 0.03 to 0.15%. Carbon is extremely effective in improving the strength of steel. To obtain the target strength, a minimum of 0.03% is required. However, if the amount of C is greater than 0.15%, a remarkable deterioration in the low temperature toughness or on-site weldability of the HAZ of the base material is invited, so the upper limit was made 0.15%. The elongation becomes higher the greater the amount of C, while the low temperature toughness and the weldability become better the smaller the amount of C. It is necessary to consider the balance by the level of the required characteristics.

Si is an element added for deoxygenation or improvement of strength, but if added in an amount greater than 0.8%, the HAZ toughness and on-site weldability are remarkably deteriorated, so the upper limit of the amount of Si was made 0.8%. Note that deoxygenation of steel is possible by Al and Ti as well. Si does not necessarily have to be added, but usually is included in an amount of 0.1% or so.

Mn is an element essential for making the microstructure of the base phase of the steel of the present invention a mainly bainite structure and securing a balance of excellent strength and low temperature toughness. The lower limit is 0.3%. However, if the amount of Mn is greater than 2.5%, it becomes difficult for the ferrite to diffuse and be produced, so the upper limit was made 2.5%.

Further, the steel of the present invention contains as essential elements Nb: 0.01 to 0.3% and Ti: 0.005 to 0.03%.

Nb not only suppresses recrystallization of austenite to make the structure finer at the time of controlled rolling, but also contributes to an increase of the quenchability and toughens the steel. The effect is small if the amount of Nb is less than 0.01%, so this is made the lower limit. However, if the amount of Nb added is greater than 0.3%, the HAZ toughness and the on-site weldability are adversely affected, so the upper limit was made 0.3%.

The addition of Ti forms fine TiN and makes the microstructure of the base material and HAZ finer and promotes the effect of improvement of the collapse strength falling due to the Bauschinger effect by heating to 80 to 550° C., in particular 80 to less than 150° C. Further, it improves the low temperature toughness of the base material and HAZ. This effect becomes extremely remarkable due to the composite addition with Nb. For this purpose, the amount of Ti is preferably added in an amount of 3.4N (all wt %) or more. Further, when the amount of Al is small (for example, 0.005% or less), Ti forms an oxide, acts as a ferrite forming nucleus in grains in the HAZ, and makes the HAZ structure finer in effect. To obtain this effect, addition of a minimum of 0.005% of Ti is necessary. However, if the amount of Ti is more than 0.03%, coarsening of TiN or precipitation hardening due to TiC occur and the low temperature toughness is degraded, so the upper limit was limited to 0.03%.

Al is an element usually included in steel as a deoxygenating material and has the effect of making the structure finer as well. However, if the amount of Al is over 0.1%, the Al-based nonmetallic inclusions increase and detract from the cleanliness of the steel, so the upper limit was made 0.1%. Further, deoxygenation is also possible with Ti and Si, so Al does not necessarily have to be added, but with current technology, 0.001% or so is included.

N forms TiN, suppresses the coarsening of the austenite grains at the time of slab reheating and at the HAZ, and improves the low temperature toughness of the base material and HAZ. The minimum amount required for this is 0.001%. However, if the amount of N becomes greater than 0.01%, the TiN increases too much and surface defects, deteriorated toughness, and other problems occur, so the upper limit has to be suppressed to 0.01%.

Further, in the present invention, the amounts of the impurity elements P and S are made 0.03% and 0.01% or less. The main reason is to further improve the low temperature toughness of the base material and HAZ. Reduction of the amount of P mitigates the center segregation of the continuously cast slab and prevents grain destruction to improve the low temperature toughness. Further, reduction of the amount of S reduces the MnS drawn by hot rolling and improves the drawing toughness in effect. With both, the less the better, but this has to be determined by the balance of characteristics and cost. Normally P and S are contained in amounts of 0.001% or more and 0.0001% or more.

Next, the objects of adding the optional elements Ni, Mo, Cr, Cu, V, Ca, REM, and Mg will be explained. The main object of adding these elements to the basic ingredients is to try to further improve the strength and toughness and increase the size of the steel material which can be produced without detracting from the excellent features of the steel of the present invention.

The object of adding Ni is to improve the low carbon steel of the present invention without degrading the low temperature toughness or on-site weldability. Addition of at least 0.1% is preferable. Addition of Ni, compared with addition of Cr and Mo, seldom forms a hard structure harmful to low temperature toughness in a rolled structure, in particular the center segregation zone of a continuously cast slab. However, if the amount of Ni is more than 1%, this causes deterioration of not only the economy, but also the HAZ toughness and on-site weldability, so the upper limit was made 1%. Further, the addition of Ni is also effective for preventing Cu cracking at the time of continuous casting and hot rolling. In this case, Ni has to be added in an amount at least ⅓ of the amount of Cu.

The reason for adding the Mo is to improve the quenchability of steel and obtain a high strength. Addition of at least 0.1% is preferable. Further, Mo is also effective in suppressing recrystallization of austenite at the time of controlled rolling together with Nb and in making the austenite structure finer. However, excessive addition of Mo over 0.6% causes deterioration of the HAZ toughness and on-site weldability and further makes dispersion and formation of ferrite difficult, so the upper limit was made 0.6%.

Cr increases the strength of the base material and welded part, so is preferably added in an amount of 0.1% or more, but if adding over 1%, the HAZ toughness and the on-site weldability are remarkably deteriorated. Therefore, the upper limit of the amount of Cr was made 1%.

Cu increases the strength of the welded part, so is preferably added in an amount of at least 0.1%, but if added more than 1%, the HAZ toughness and on-site weldability are remarkably deteriorated. Therefore, the upper limit of the amount of Cu was made 1%.

V has substantially the same effect as Nb, but the effect is weak relative to Nb. Further, it has the effect of suppressing the softening of the weld. As the upper limit, up to 0.3% is allowable from the viewpoint of the HAZ toughness and on-site weldability, but addition of 0.03 to 0.08% is particularly preferable.

B is an element for raising the quenchability of the steel by addition of a very small amount. This effect is insufficient if the amount of B is less than 0.0003%, so the lower limit of the amount of B was made 0.0003%. On the other hand, if excessively adding B more than 0.003%, this promotes the formation of $Fe_{23}(C,B)_6$ and other brittle grains and causes deterioration of the low temperature toughness, so the upper limit of the amount of B was made 0.003%.

Ca and REM control the form of the sulfides (MnS) and improve the low temperature toughness. To obtain these effects, it is preferable to add Ca in an amount of 0.001% or more and REM in an amount of 0.002% or more. If adding an amount of Ca more than 0.01% and REM more than 0.02%, a large amount of CaO—CaS or REM-CaS is produced resulting in large sized clusters and large sized inclusions and not only impairs the cleanliness of the steel, but also adversely affects the on-site weldability. Therefore, the upper limits of the amounts of addition of Ca and REM were limited to 0.01% and 0.02%. Note that in a super high strength line pipe, it is particularly effective to reduce the amount of S and the amount of 0 to 0.001% and 0.002% or less and make ESSP=(Ca)[1-124(O)]/1.25S $0.5 \leqq ESSP \leqq 10.0$.

Mg forms finely dispersed oxides, suppresses the grain coarsening of the welding HAZ, and improves the low temperature toughness, so is preferably added in an amount of 0.0001% or more. However, if adding more than 0.006%, it forms coarse oxides and degrades the toughness, so 0.006% was made the upper limit.

Next, the method of production will be explained.

First, the steel is reheated to the austenite region before rolling heating. It is necessary to raise the temperature to the temperature at which Nb dissolves. This reheating is preferably in the range of 1050° C. to 1250° C. where Nb dissolves and the grains do not become coarse.

After reheating, coarse rolling is performed in the recrystallization temperature region and then finishing rolling is performed in the non-recrystallization temperature region of 900° C. or less. This is to raise the low temperature toughness basically required for line pipe. Note that with an end temperature of the finishing rolling of less than the $Ar_3$ point, after cooling, a structure including upper bainite or another low temperature transformation phase and containing C or Nb in solid solution cannot be obtained, so the $Ar_3$ point is made the lower limit of the end temperature of the finishing rolling. The cumulative reduction rate of the finishing rolling is made 50% or more. This is so as to secure the low temperature toughness required for line pipe. The upper limit of the cumulative reduction rate of finishing rolling is determined by the ratio of the thickness at the time of recrystallization rolling end and the product plate thickness.

After finishing rolling, the steel is cooled from the temperature of the $Ar_3$ point or more to 300° C. or less. This is so as to obtain a structure including upper bainite or another low temperature transformation phase and containing C or Nb in solid solution. The lower limit of the cooling end temperature is not particularly limited from the characteristics, but normally is in the range of 50 to 150° C. The cooling rate when cooling from a temperature of the $Ar_3$ point or more to 300° C. or less is made 5 to 40° C./sec. This is so as to obtain a structure including upper bainite or another low temperature transformation phase and containing C or Nb in solid solution.

The steel plate produced in this way is successively C-ed, U-ed, and O-ed to form it into a cylinder and is joined at the abutting parts. This is then welded, then expanded to improve the circularity.

To improve the collapse strength, it is necessary to heat the range at least from the outside surface side to the center of thickness to 80 to 550° C. If the heating temperature is less than 80° C., even with the steel of the present invention, there is almost no recovery of the compression strength which dropped due to the Bauschinger effect. On the other than, if heating to a high temperature over 550° C., softening occurs, so conversely the compression yield strength falls. Therefore, the heating temperature is made the range of 80 to 550° C., but the effect is large even in the range of 80 to 250° C. In particular, an effect is recognized even at a low temperature of 80 to less than 150° C. For the inside or outside surface side, there is almost no change with heating in this temperature region, so heating is not necessarily required.

For the holding time at the heating temperature, at a high temperature, it is possible to cool immediately after the heat treatment temperature is reached, while at a low temperature, it is also possible to hold the temperature for 6000 seconds or less. The preferable range is 60 to 1800 seconds.

Further, the method of using induction heating to heat the outside surface is effective, but in addition to induction heating, an oil tank or salt bath may also be used.

The collapse strength of UOE steel pipe produced in this way has to be at least equal to the collapse strength calculated from the compression strength of the thick plate after hot rolling. A ratio b/a of the collapse strength a [MPa] of the steel pipe produced by the UOE process and the collapse strength b [MPa] of the steel pipe after heating at least a range from the outside surface to the center of thickness to 80 to 550° C. of 1.10 or more means equal or better to the collapse strength calculated from the compression strength of the thick plate after hot rolling. FIG. 12 shows the difference in the compression/tension yield ratio at the outer surface and inner surface of the steel pipe.

To prevent corrosion, the outer surface of the steel pipe may also be coated. In submarine line pipe, this is mainly plastic coating, but to raise the bonding strength, this has to be performed at a temperature of 150 to 250° C. or so. Even if heating at the time of this coating, the Bauschinger effect is recovered from, so the efficiency is extremely good.

EXAMPLES

Example 1

Figure 1:
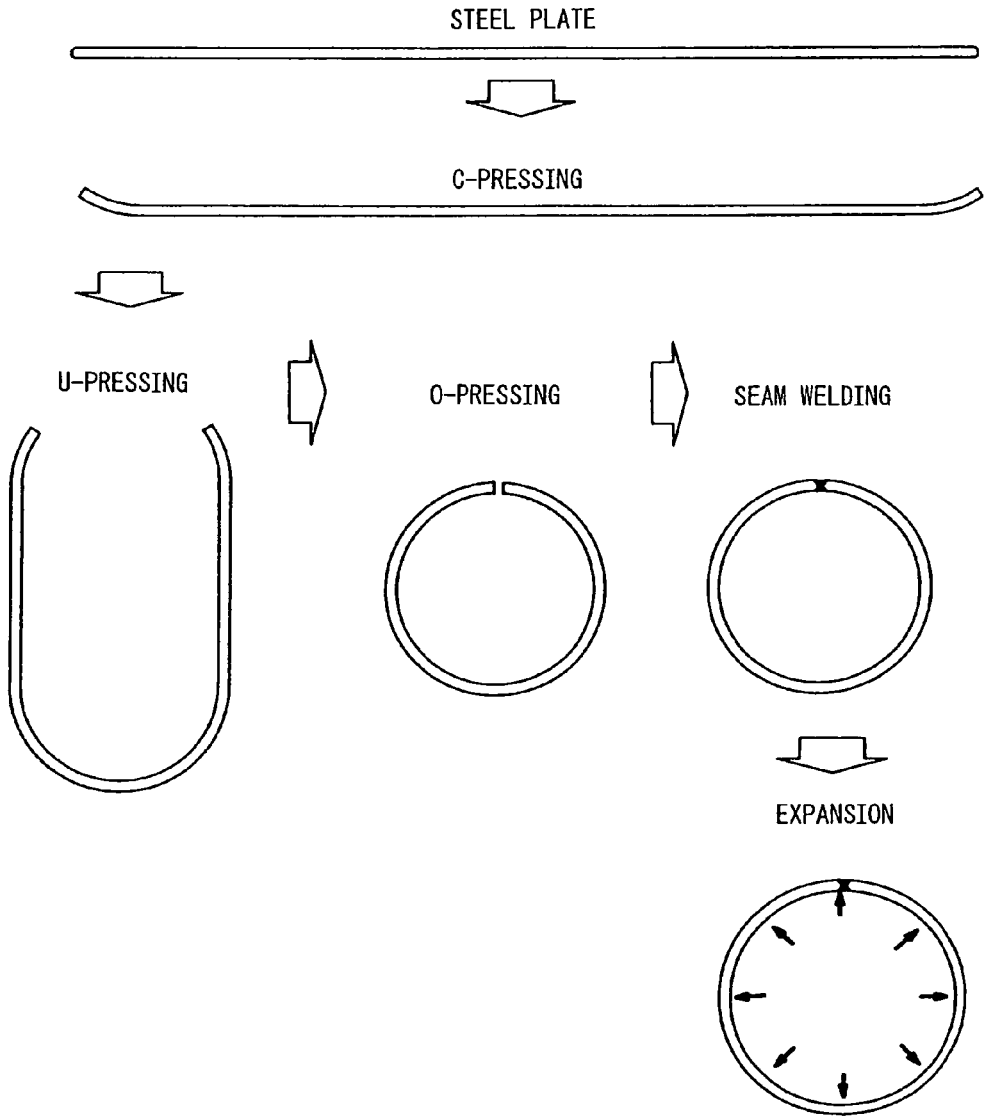
FIG. 1 is a schematic view of a steel pipe production process according to the UOE system.
Figure 2:
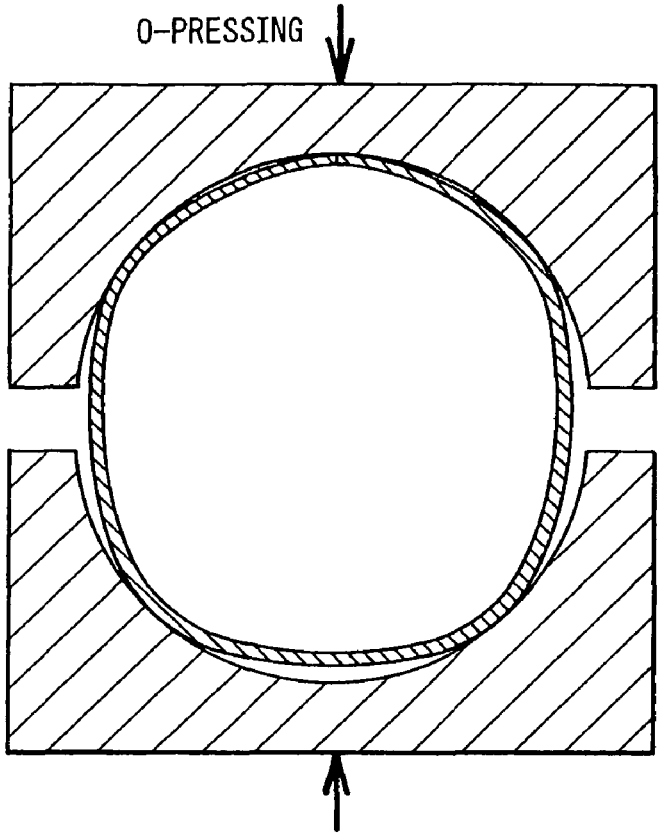
FIG. 2 is a schematic view of O-ing.
Figure 3:
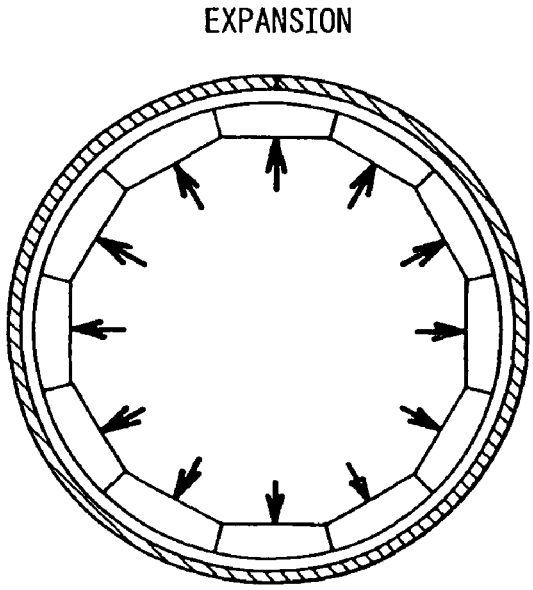
FIG. 3 is a schematic view of expansion.

UOE steel pipe of grades of X-65, X80, and X100 and outside diameters and thicknesses in the ranges of 660 to 711 mm and 25 to 38 mm were produced by the method shown in FIG. 1. These were given heat treatment under the conditions shown in Table 1. Note that the temperatures of the outside surfaces and inside surfaces of the steel pipe were measured by thermocouples. The collapse strengths of these steel pipe were measured by a single-axis collapse test. The single-axis collapse test was conducted by placing steel pipe of a length of 5 m as a collapse test sample in a pressure vessel and applying water pressure so that axial force did not occur in the steel pipe. The yield stresses of compression and tension were measured for ¼ the total thickness from the outside surface as the outer surface and for ¼ the total thickness from the inside surface as the inner surface and the ratio of these was examined. The test pieces measured for compression yield stress at this time were columns of a diameter of 6 mm and a length of 15 mm, while the test pieces measured for tension yield stress were tension test pieces having columnar parallel parts of diameters of 6 mm and lengths of 15 mm together with this. The results are shown in Table 1 and FIG. 8. Production Nos. 1 to 6 and 9 to 12 were given heat treatment by induction heating, while Production Nos. 7 and 8 were given heat treatment combining ambient heating and forced cooling. When the heating temperature was 400° C. or more, the rise in temperature was sharp, so the heat treatment time means the time the temperature was exceeded for the outer surface temperature and means the time when the temperature was in the temperature range of the maximum temperature −10° C. for the inside surface temperature.

Production Nos. 13, 15, 17, and 18 were not given heat treatment, so fell greatly in collapse strength compared with Production Nos. 1 to 3, 4 to 8, 9, and 10 of the same size and same grade and in the scope of the present invention. Further, Production No. 14 had heat treatment conditions of the inside surface outside the scope of the present invention, so it was learned that the collapse strength clearly fell from Production No. 1 in the scope of the present invention with an outside surface heated to the same temperature.

Further, Production No. 16 had heat treatment conditions of the outside surface and inside surface outside the scope of the present invention, so the collapse stress clearly fell from Production No. 6 inside the scope of the present invention with the outside surface heated up to the same temperature. Production No. 11 was UOE steel pipe of a grade of X-100 which was given heat treatment in the scope of the present invention. A high collapse strength was obtained as a result of the collapse test.

FIG. 8 compares the ratio of the yield stress of compression and tension at the outer surface and inner surface. In the figure, the square marks of Invention 1 are not differentiated as to particular example, but are data of the present invention of Table 1. In the same way, the triangle marks are data of the comparative examples. In the comparative examples, pipes where the compression/tension yield ratio did not reach 90% at the outer surface and where it ended up falling to less than 100% at the inner surface are seen. However, in the present invention, the compression/tension yield ratio fell in the range of 90% to 100% at the outer surface and became 110% or more at the inner surface. Corresponding to this, in the pipes of the invention, the collapse strength became about 8 to 50% higher compared with the comparative examples obtained under similar production conditions.

ratio, upset rate, and expansion rate shown in Table 2. Compression test pieces of columnar shapes of diameters of 6 mm and lengths of 15 mm long in the circumferential direction were cut out from the steel pipe from ¼ the total thickness from the outside surface and measured for the compression yield strength. The results are shown as the compression yield strength maintenance rate. Single-axis collapse tests were conducted and the collapse strength measured by placing steel pipe of lengths of 5 m as collapse test samples in a pressure vessel and applying water pressure so that axial force did not occur in the steel pipe. The yield stresses of compression and tension were measured for ¼ the total thickness from the outside surface as the outer surface and for ¼ the total thickness from the inside surface as the inner surface and the ratio of these was examined. The test pieces measured for compression yield stress at this time were columns of a diameter of 6 mm and a length of 15 mm, while the test pieces measured for tension yield stress were tension test pieces having columnar parallel parts of diameters of 6 mm and lengths of 15 mm together with this. The results are shown in Table 2 and FIG. 11.

Production Nos. 1 to 4 had ratios of the upset rate and expansion rate in the scope of the present invention and had rates of maintenance of the compression yield strength larger than Production Nos. 14 to 17 with the same grades and outside diameter/thickness ratio and $\alpha/\beta$ ratios of less than 0.35. Further, collapse tests were conducted on steel pipe of Production Nos. 1, 2, and 14, whereupon the collapse strengths of Production Nos. 1 and 2 in the scope of the present invention were higher than Production No. 14 outside the scope of the present invention, so the effects of the present invention could be verified. Further, Production No. 5 had a larger steel pipe compression yield strength ratio with respect to the plate material yield strength than Production No. 18 of the same grade and outside diameter/thickness ratio and an $\alpha/\beta$ ratio of less than 0.35.

TABLE 1

| | | | | Heat treatment | | | | Compression/tension yield ratio | | | |
|---|---|---|---|---|---|---|---|---|---|---|---|
| | Outside | | | Outside surface | | Inside surface | | Outside | Inside | Collapse | |
| Production no. | diameter (mm) | Thickness (mm) | Gradel | Temp. (° C.) | Time (sec) | Temp. (° C.) | Time (sec) | surface (%) | surface (%) | strength (MPa) | |
| 1 | 660 | 25 | X-65 | 550 | 2 | 330 | 8 | 96 | 125 | 24.7 | Inv. |
| 2 | | | | 500 | 5 | 300 | 15 | 92 | 128 | 23.9 | ex. |
| 3 | | | | 400 | 20 | 300 | 30 | 90 | 110 | 23.0 | |
| 4 | 660 | 38 | X-65 | 530 | 5 | 300 | 20 | 98 | 112 | 51.8 | |
| 5 | | | | 480 | 3 | 280 | 50 | 92 | 112 | 49.1 | |
| 6 | | | | 420 | 12 | 290 | 40 | 91 | 111 | 51.5 | |
| 7 | | | | 300 | 240 | 250 | 140 | 90 | 112 | 49.3 | |
| 8 | | | | 200 | 3500 | 150 | 3500 | 94 | 116 | 49.1 | |
| 9 | 660 | 32 | X-80 | 500 | 10 | 305 | 23 | 98 | 111 | 39.1 | |
| 10 | | | | 420 | 10 | 260 | 60 | 92 | 112 | 39.3 | |
| 11 | 660 | 32 | X-100 | 450 | 5 | 330 | 10 | 93 | 117 | 43.1 | |
| 12 | 711 | 35 | X-65 | 430 | 10 | 300 | 20 | 95 | 123 | 37.7 | |
| 13 | 660 | 25 | X-65 | None | | | | 76 | 134 | 19.6 | Comp. |
| 14 | | | | 550 | 180 | 540 | 160 | 100 | 103 | 22.5 | ex. |
| 15 | 660 | 38 | X-65 | None | | | | 74 | 124 | 37.2 | |
| 16 | | | | 420 | 1800 | 410 | 1600 | 99 | 99 | 47.0 | |
| 17 | 660 | 32 | X-80 | None | | | | 80 | 123 | 28.7 | |
| 18 | 711 | 35 | X-65 | None | | | | 82 | 115 | 30.3 | |

(Note)
Underlines are conditions outside scope of present invention.

Example 2

UOE steel pipe of grades of X-65 and X80 and outside diameters and thicknesses in the ranges of 660 to 711 mm and 25 to 38 mm were produced by the outside diameter/thickness FIG. 11 compares the ratio of the yield stress of compression and tension at the outer surface and inner surface. In the figure, the square marks of Invention 2 are not differentiated as to particular example, but are data of the present invention of Table 2. In the same way, the triangle marks are data of the comparative examples. In the comparative examples, pipes where the compression/tension yield ratio did not reach 90% at the outer surface even if reaching 105% or more at the inner surface were often seen. However, in the present invention, the compression/tension yield ratio fell in the range of 90% to 100% at the outer surface and became 110% or more at the inner surface. Corresponding to this, in the pipes of the invention, the collapse strength became about 7 to 20% higher compared with the comparative examples obtained under similar production conditions.

TABLE 2

| Production no. | Outside dia./ inside dia. | Steel type | Upset rate α (%) | Expansion rate β (%) | α/β | Ratio with respect to plate yield strength (%) | Compression/tension yield ratio of steel plate: Outside surface (%) | Compression/tension yield ratio of steel plate: Inside surface (%) | Collapse strength (MPa) | |
|---|---|---|---|---|---|---|---|---|---|---|
| 1 | 18.7 | X-65 | 0.4 | 1 | 0.40 | 88 | 92 | 139 | 42.9 | Inv. |
| 2 | 18.7 | X-65 | 0.5 | 1 | 0.50 | 92 | 94 | 136 | 42.7 | ex. |
| 3 | 18.7 | X-65 | 0.5 | 1.4 | 0.36 | 88.8 | 93 | 130 | 41.0 | |
| 4 | 18.7 | X-65 | 0.3 | 0.8 | 0.38 | 89 | 90 | 119 | 41.5 | |
| 5 | 26 | X-80 | 0.5 | 0.8 | 0.63 | 93 | 97 | 110 | 24.7 | |
| 14 | 18.7 | X-65 | 0.1 | 1 | 0.10 | 72 | 76 | 119 | 35.7 | Comp. |
| 15 | 18.7 | X-65 | 0.11 | 0.85 | 0.13 | 74 | 80 | 123 | 36.5 | ex. |
| 16 | 18.7 | X-65 | 0.2 | 1.5 | 0.13 | 74.6 | 83 | 131 | 35.7 | |
| 17 | 18.7 | X-65 | 0.25 | 1.2 | 0.21 | 81 | 85 | 133 | 36.8 | |
| 18 | 26 | X-80 | 0.15 | 1 | 0.15 | 80 | 82 | 93 | 22.9 | |

(Note)

Underlines are conditions outside scope of present invention.

Example 3

Steels having the chemical compositions shown in Table 3 were produced by a converter and continuously cast to steel slabs which were then hot rolled under the conditions shown in Table 4. The end temperature of the finishing rolling was at least the $Ar_3$ point in each case. These steel plates were successively C-ed, U-ed, and O-ed as they were. The ends of the thick steel plates were seam welded, then the pipes were expanded in an UOE process to obtain steel pipe of the production conditions, outside diameters, and thicknesses shown in Table 4. These steel pipe were heated by the moving heating system at a high frequency. The temperatures of the outside surfaces and inside surfaces of the steel pipe were measured by a thermocouple. The temperatures of the centers of thickness were calculated as the average values of the outside surface temperatures and the inside surface temperatures. The heating temperatures shown in Table 4 are the temperatures of the outermost surfaces, while the actual heating times were about 180 seconds. The temperatures of the inside surfaces were not particularly controlled, but were about 30° C. lower than the outside surface temperatures. Therefore, the temperatures at the centers of thickness became about 15° C. lower than the outside surface temperatures.

The steel pipe produced in this way were cut to 5 m, the steel pipe were placed in reaction vessels, and water pressure was applied so that no axial force was generated at the steel pipe in a single-axis collapse test. The pressure when applying water pressure and when the water pressure began to fall sharply was made the collapse strength. The collapse strength a [MPa] up to production of these steel pipe, the collapse strength b [MPa] after heat treatment, and the ratio b/a of the two are shown in Table 4. The yield stresses of compression and tension were measured for ¼ the total thickness from the outside surface as the outer surface and for ¼ the total thickness from the inside surface as the inner surface and the ratio of these was examined. The test pieces measured for compression yield stress at this time were columns of a diameter of 6 mm and a length of 15 mm, while the test pieces measured for tension yield stress were tension test pieces having columnar parallel parts of diameters of 6 mm and lengths of 15 mm together with this. The results are also inserted into Table 4 and shown in FIG. 12.

In Examples 1 to 9 of the method of the present invention, due to the heating, the collapse strength rose 18 to 29% and steel pipe of a high collapse strength were obtained. In particular, even if heating to a low temperature of less than 150° C., the collapse strength improved, while even if 150° C. or more, as will be understood from a comparison with Examples 2 and 11, the steel produced by the method of production of the present invention rose in collapse strength more. In Examples 10 and 12, since the cooling stop temperature was high, with heating at 140° C., the collapse strength was not improved and the collapse strength was low. Example 11 had a high heating temperature of 300° C., but the cooling stop temperature was high, so the collapse strength was not improved. Example 14 did not include Nb—Ti, so had a chemical composition outside the present invention and therefore the collapse strength was not improved.

FIG. 12 compares the ratio of the compression and tension yield stresses at the outer surface and inner surface. In the figure, the square marks of Invention 3 are not differentiated as to particular example, but are data of the present invention of Table 4. In the same way, the triangle marks are data of the comparative examples. In the comparative examples, pipes where the compression/tension yield ratio did not reach 90% at the outer surface even if reaching 105% or more at the inner surface were often seen. However, in the present invention, the compression/tension yield ratio fell in the range of 90% to 100% at the outer surface and became 105% or more at the inner surface. Corresponding to this, the collapse strength was only improved about 3% in the comparative examples obtained under similar production conditions, but was improved 18 to 29% in the present invention.

TABLE 3

| No. | C | Si | Mn | P | S | Nb | Ti | Al | N | Ni | Mo | Cr | Cu | V | Other | $Ar_3$ point/° C. | Ceq | |
|---|---|---|---|---|---|---|---|---|---|---|---|---|---|---|---|---|---|---|
| A | 0.06 | 0.18 | 1.96 | 0.006 | 0.001 | 0.038 | 0.014 | 0.015 | 0.0028 | — | 0.18 | — | — | — | | 710 | 0.423 | Inv. |
| B | 0.08 | 0.22 | 1.85 | 0.007 | 0.002 | 0.042 | 0.015 | 0.026 | 0.0031 | — | 0.12 | — | — | — | Mg: 0.0013 | 700 | 0.412 | ex. |
| C | 0.04 | 0.15 | 1.44 | 0.008 | 0.002 | 0.045 | 0.016 | 0.003 | 0.0025 | 0.4 | — | 0.48 | 0.17 | — | | 720 | 0.414 | |
| D | 0.08 | 0.12 | 1.87 | 0.005 | 0.001 | 0.034 | 0.015 | 0.024 | 0.0032 | — | — | — | — | 0.04 | Ca: 0.0024 | 730 | 0.400 | |
| E | 0.06 | 0.26 | 1.61 | 0.013 | 0.003 | 0.045 | 0.014 | 0.018 | 0.0034 | 0.3 | 0.11 | — | 0.5 | — | REM: 0.0035 | 740 | 0.404 | |
| F | 0.05 | 0.33 | 1.92 | 0.015 | 0.002 | 0.044 | 0.016 | 0.022 | 0.0029 | — | 0.25 | — | — | 0.04 | | 750 | 0.428 | |
| G | 0.07 | 0.27 | 1.89 | 0.008 | 0.002 | 0.003 | 0.004 | 0.014 | 0.0035 | — | 0.21 | — | — | — | | 710 | 0.427 | Comp. ex. |

— in table indicate below limit of detection.
Underlines indicate outside scope of present invention.
$Ar_3$ point is transformation temperature of air-cooling equivalent of 15 to 20 mm thick steel plate. Ceq = C + Mn/6 + (Ni + Cu)/15 + (Cr + Mo + V)/5

TABLE 4

| | Production conditions | | | | | | | | | Compression/tension yield ratio | | Collapse test | | | |
|---|---|---|---|---|---|---|---|---|---|---|---|---|---|---|---|
| | Steel no. | Reheating temp. ° C. | Non-recryst. region cum. red. rate % | Cooling rate ° C./s | Cooling stop temp. ° C. | Outside dia. mm | Thickness mm | Grade | Heating temp. ° C. | Outside surface (%) | Inside surface (%) | Preheating collapse strength a MPa | Postheating collapse strength b MPa | b/a | |
| 1 | A | 1150 | 80 | 30 | 250 | 660 | 25 | X80 | 140° C. | 94 | 128 | 24.4 | 30.3 | 1.24 | Inv. |
| 2 | A | 1150 | 80 | 30 | 250 | 660 | 25 | X80 | 300° C. | 97 | 105 | 24.4 | 31.5 | 1.29 | ex. |
| 3 | A | 1150 | 70 | 15 | 100 | 660 | 38 | X70 | 100° C. | 92 | 109 | 45.6 | 53.8 | 1.18 | |
| 4 | B | 1150 | 80 | 20 | 150 | 660 | 32 | X65 | 140° C. | 91 | 130 | 32.4 | 39.9 | 1.23 | |
| 5 | C | 1150 | 80 | 20 | 150 | 660 | 32 | X65 | 140° C. | 96 | 111 | 31.8 | 40.4 | 1.27 | |
| 6 | C | 1150 | 80 | 20 | 150 | 660 | 32 | X65 | 450° C. | 98 | 105 | 31.8 | 40.5 | 1.26 | |
| 7 | D | 1150 | 80 | 20 | 150 | 660 | 32 | X65 | 140° C. | 94 | 112 | 32.9 | 41.2 | 1.23 | |
| 8 | E | 1150 | 80 | 20 | 150 | 660 | 32 | X70 | 140° C. | 90 | 133 | 32.7 | 32.0 | 1.26 | |
| 9 | F | 1150 | 80 | 30 | 150 | 660 | 25 | X100 | 140° C. | 98 | 111 | 26.0 | 42.6 | 1.23 | |
| 10 | A | 1150 | 70 | 15 | 500 | 660 | 38 | X65 | 140° C. | 78 | 124 | 42.6 | 43.4 | 1.00 | Comp. |
| 11 | A | 1150 | 70 | 15 | 500 | 660 | 38 | X65 | 300° C. | Not meas. | Not meas. | 42.5 | 43.4 | 1.02 | ex. |
| 12 | F | 1150 | 80 | 30 | 500 | 660 | 25 | X100 | 140° C. | 74 | 111 | 25.1 | 25.1 | 1.00 | |
| 13 | G | 1150 | 80 | 20 | 150 | 660 | 32 | X65 | 140° C. | 79 | 123 | 31.8 | 32.1 | 1.01 | |
| 14 | G | 1150 | 80 | 20 | 150 | 660 | 32 | X65 | 300° C. | Not meas. | No. meas. | 31.8 | 32.8 | 1.03 | |

(Note)
Underlines are conditions outside scope of present invention.

INDUSTRIAL APPLICABILITY

As explained above, according to the present invention, by imparting a different heat hysteresis to the outside surface and inside surface of steel pipe, it is possible to impart a higher collapse resistance to steel pipe produced by the UOE process and possible to provide UOE steel pipe excellent in collapse strength at a low cost.

Further, according to the present invention, by specifying the ratio of the upset rate at the time of O-ing and the expansion rate at the time of expansion for steel pipe produced by the UOE process, it is possible to impart a high collapse resistance and possible to provide UOE steel pipe excellent in collapse strength at a low cost. Further, by imparting a different heat hysteresis to the outside surface and inside surface of steel pipe, it is possible to impart a higher collapse resistance to steel pipe produced by the UOE process and possible to provide UOE steel pipe excellent in collapse strength at a low cost. This enables use for line pipe etc. for transporting natural gas, crude oil, etc. even in environments in which high collapse strength is required such as the deep sea.

The invention claimed is:

1. A method of production of UOE steel pipe excellent in collapse strength, comprising successively C-ing, U-ing, and O-ing steel plate, seam welding the ends of the steel pipe, and expanding the pipe, said method of production of UOE steel pipe characterized by applying heat treatment after producing the UOE steel pipe, 0consisting essentially of, by wt %, C: 0.03 to 0.15%, Si: 0.8% or less, Mn: 0.3 to 2.5%, P: 0.03% or less, S: 0.01% or less, Nb: 0.01 to 0.3%, Ti: 0.005 to 0.03%, Al: 0.1% or less, N: 0.001 to 0.01%, Mo: 0.6% or less, one or more of Ca: 0.01% or less, REM: 0.02% or less, and Mg: 0.006% or less, and a balance of Fe and unavoidable impurities, so that a heating temperature $T_1$ of the outside surface of said steel pipe and a heating time $t_1$ of the outside surface satisfy the following formula (1) and a heating temperature $T_2$ of an inside surface of said steel pipe and a heating time $t_2$ of the inside surface satisfy the following formula (2):

$$T_1-503 \geqq -37.6\times\ln t_1 \quad (1)$$

$$T_2-407 < -31.3\times\ln t_2 \quad (2)$$

where, $T_1$: heating temperature of outside surface of steel pipe (° C.), $t_1$: heating time of outside surface of steel pipe (s), $T_2$: heating temperature of inside surface of steel pipe (° C.), $t_2$: heating time of inside surface of steel pipe (s).

2. A method of production of UOE steel pipe excellent in collapse strength as set forth in claim 1, said method of production of UOE steel pipe characterized in that said heat treatment is performed by induction heating.

3. A method of production of UOE steel pipe excellent in collapse strength as set forth in claim 2, said method of production of a UOE steel pipe characterized by coating the pipe during said heat treatment or during the cooling after the heat treatment.

* * * * *